US011441573B2

(12) United States Patent
Okazaki et al.

(10) Patent No.: US 11,441,573 B2
(45) Date of Patent: Sep. 13, 2022

(54) FLUID MACHINE

(71) Applicant: KABUSHIKI KAISHA TOYOTA JIDOSHOKKI, Kariya (JP)

(72) Inventors: Kazuki Okazaki, Aichi-ken (JP); Junya Suzuki, Aichi-ken (JP); Hidefumi Mori, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 17/237,636

(22) Filed: Apr. 22, 2021

(65) Prior Publication Data

US 2021/0340990 A1 Nov. 4, 2021

(30) Foreign Application Priority Data

May 1, 2020 (JP) ..... JP2020-081289

(51) Int. Cl.

| | |
|---|---|
| ***F01D 5/02*** | (2006.01) |
| ***F04D 29/20*** | (2006.01) |
| ***F04D 29/26*** | (2006.01) |
| ***F04D 25/06*** | (2006.01) |
| ***F04D 29/42*** | (2006.01) |
| ***F04D 17/10*** | (2006.01) |
| ***F04D 27/00*** | (2006.01) |
| ***F04D 29/12*** | (2006.01) |

(52) U.S. Cl.

CPC ..... *F04D 29/266* (2013.01); *F04D 17/10* (2013.01); *F04D 25/06* (2013.01); *F04D 27/001* (2013.01); *F04D 29/122* (2013.01); *F04D 29/4206* (2013.01)

(58) Field of Classification Search

CPC ..... F01D 5/025; F01D 25/24; F04D 17/10; F04D 29/266; F05D 2260/31

See application file for complete search history.

(56) References Cited

U.S. PATENT DOCUMENTS 2,799,445 A * 7/1957 Hull ..... F01D 5/048 416/244 R
4,872,817 A * 10/1989 De Kruif ..... F01D 5/025 417/407

(Continued)

FOREIGN PATENT DOCUMENTS

DE 112013005022 T5 7/2015
JP 2010-144537 A 7/2010

(Continued)

*Primary Examiner* — Ninh H. Nguyen
(74) *Attorney, Agent, or Firm* — Sughrue Mion, PLLC

(57) ABSTRACT

A fluid machine includes a bladed wheel, a resolver, a first fastener, and a second fastener. A resolver rotor is held between the first fastener and the rotary shaft and fixed to a large-diameter portion of the rotary shaft. The bladed wheel is held between the second fastener and the rotary shaft and fixed to a small-diameter portion of the rotary shaft. While the resolver rotor is fixed by the first fastener in a same direction as the bladed wheel is fixed by the second fastener along an axial direction of the rotary shaft, and the resolver rotor is fixed by the first fastener at a position away in a radial direction of the rotary shaft from a position where the bladed wheel is fixed by the second fastener so that the resolver rotor does not receive an axial force from the second fastener.

4 Claims, 3 Drawing Sheets

(56) References Cited

U.S. PATENT DOCUMENTS

| | | | | |
|---|---|---|---|---|
| 9,945,288 | B2 * | 4/2018 | Naruoka | F02B 39/12 |
| 11,221,012 | B2 * | 1/2022 | Mori | F04D 29/5806 |
| 2015/0285263 | A1 | 10/2015 | Bucking | |

FOREIGN PATENT DOCUMENTS

| | | | |
|---|---|---|---|
| JP | 2017-158395 | A | 9/2017 |
| JP | 2020-7989 | A | 1/2020 |

* cited by examiner

FLUID MACHINE

CROSS-REFERENCE TO RELATED APPLICATION

This application claims priority to Japanese Patent Application No. 2020-081289 filed on May 1, 2020, the entire disclosure of which is incorporated herein by reference.

The present disclosure relates to a fluid machine.

BACKGROUND ART

Japanese Patent Application Publication No. 2010-144537, for example, mentions a fluid machine having a bladed wheel that is rotated together with a rotary shaft. This rotary shaft is required to be rotated at a high speed by an electric motor. Japanese Patent Application Publication No. 2017-158395, for example, mentions a resolver that is configured to sense a rotation angle of a motor rotor of the electric motor. The resolver includes a resolver rotor that is fixed to the rotary shaft and has a cylindrical shape. The bladed wheel is fixed to the rotary shaft.

However, the resolver rotor and the bladed wheel fixed to the rotary shaft may be unstable if creep occurs in the resolver rotor, for example. This may cause runout of the rotary shaft when the rotary shaft is rotated, and may prevent high-speed rotation of the rotary shaft by the electric motor.

The present disclosure, which has been made in light of the above-mentioned problem, is directed to providing a fluid machine that allows a rotary shaft to be rotated at a high speed by an electric motor.

SUMMARY

In accordance with an aspect of the present invention, there is provided a fluid machine that includes a bladed wheel, an electric motor, a resolver, a first fastener, and a second fastener. The bladed wheel is rotated together with a rotary shaft. The electric motor includes a motor rotor fixed to the rotary shaft, and is configured to rotate the rotary shaft. The resolver includes a resolver rotor that has a cylindrical shape, and is configured to sense a rotation angle of the motor rotor. The first fastener fixes the resolver rotor to the rotary shaft. The second fastener fixes the bladed wheel to the rotary shaft. The rotary shaft has a large-diameter portion and a small-diameter portion that has a diameter smaller than a diameter of the large-diameter portion. The resolver rotor is held between the first fastener and the rotary shaft and fixed to the large-diameter portion. The bladed wheel is held between the second fastener and the rotary shaft and fixed to the small-diameter portion. While the resolver rotor is fixed by the first fastener in a same direction as the bladed wheel is fixed by the second fastener along an axial direction of the rotary shaft, the resolver rotor is fixed by the first fastener at a position away in a radial direction of the rotary shaft from a position where the bladed wheel is fixed by the second fastener so that the resolver rotor does not receive an axial force from the second fastener.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure together with objects and advantages thereof, may best be understood by reference to the following description of the embodiment together with the accompanying drawings in which.

DETAILED DESCRIPTION OF THE EMBODIMENTS

First Embodiment

Figure 1:
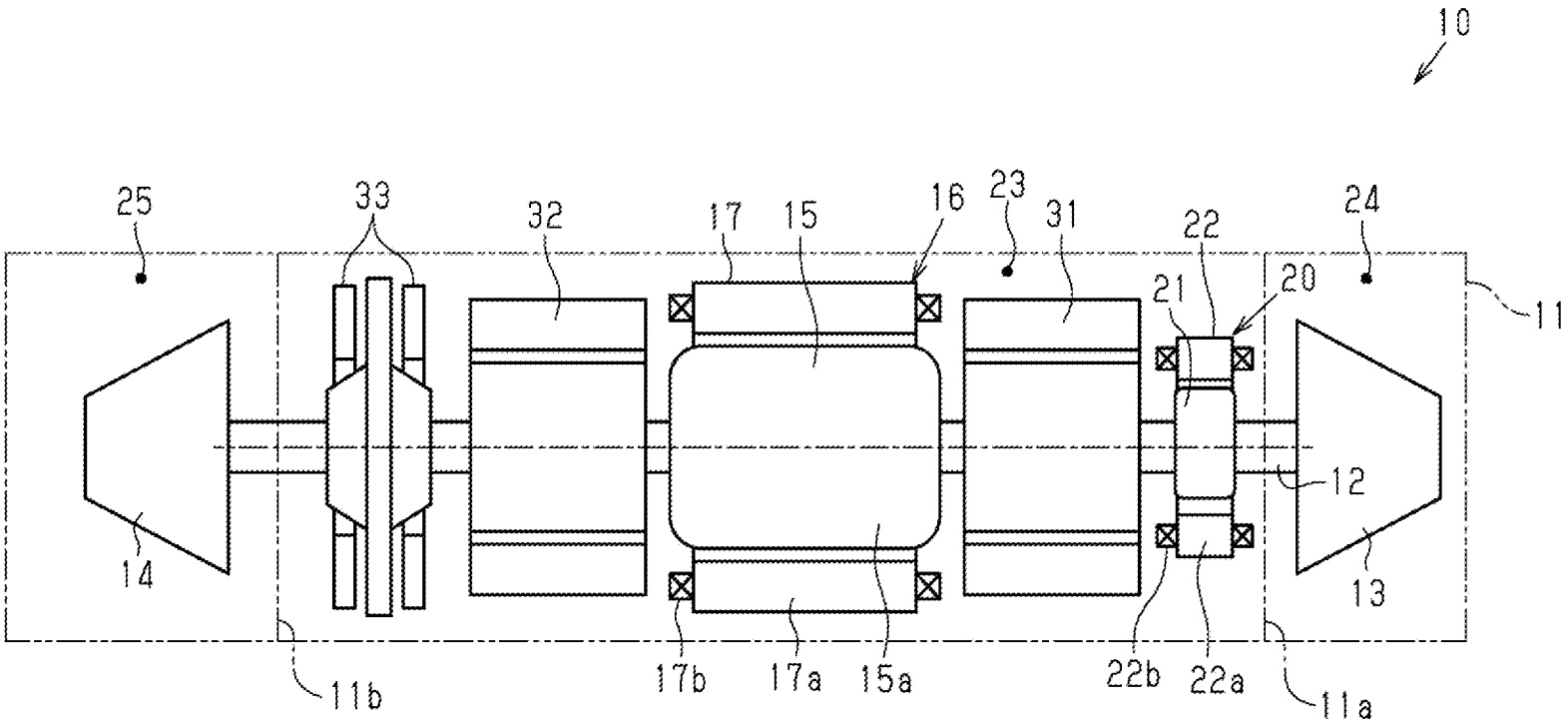
FIG. 1 is a schematic view of a fluid machine according to a first embodiment of the present disclosure.
Figure 2:
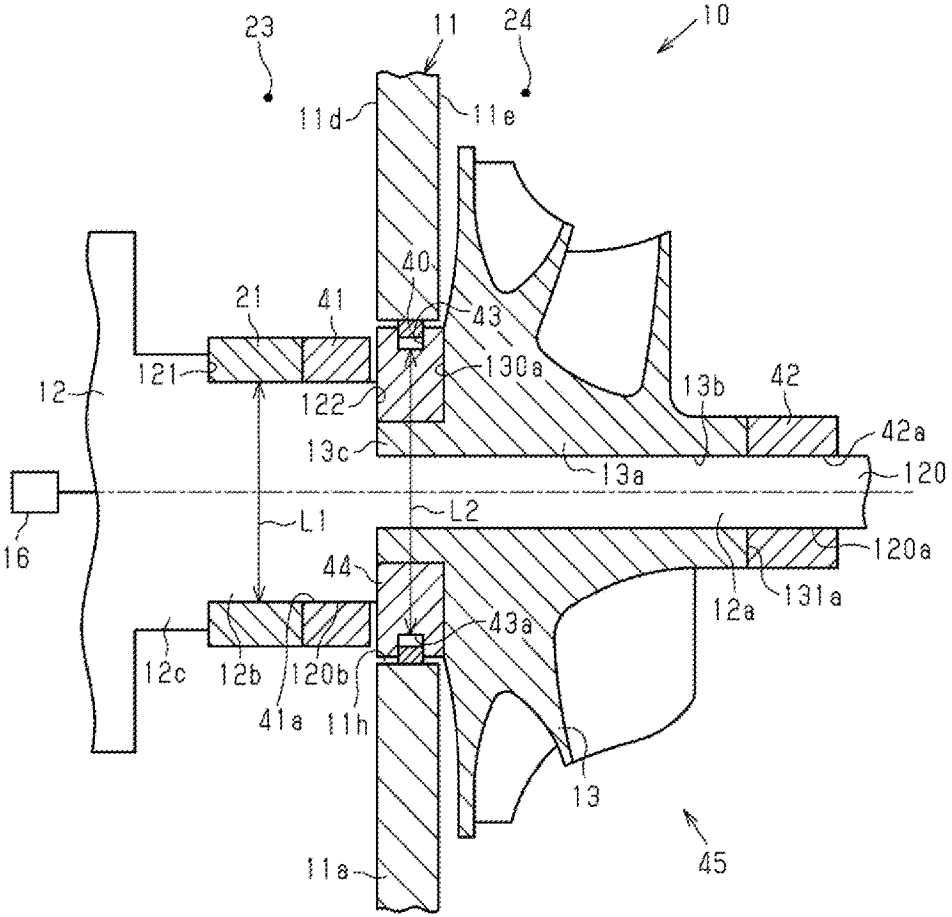
FIG. 2 is an enlarged sectional view of a part of the fluid machine.

The following will describe a first embodiment of a fluid machine with reference to accompanying FIGS. 1 and 2.

As illustrated in FIG. 1, a fluid machine 10 includes a housing 11 having a cylindrical shape and a rotary shaft 12 accommodated in the housing 11. The housing 11 is coaxial with the rotary shaft 12. The housing 11 has a motor chamber 23, a turbine chamber 24, and an impeller chamber 25. The turbine chamber 24, the motor chamber 23, and the impeller chamber 25 are arranged in this order from one end to the other end of the rotary shaft 12 along an axial direction of the rotary shaft 12.

The housing 11 includes a first partition wall 11*a* and a second partition wall 11*b* that partition the housing 11 into the motor chamber 23, the turbine chamber 24, and the impeller chamber 25. The first partition wall 11*a* is disposed between the motor chamber 23 and the turbine chamber 24, and the second partition wall 11*b* is disposed between the motor chamber 23 and the impeller chamber 25. The motor chamber 23 accommodates an electric motor 16 and a resolver 20. The motor chamber 23 serves as a first accommodation chamber for accommodating the electric motor 16 and the resolver 20. The turbine chamber 24 accommodates a turbine wheel 13 that serves as a bladed wheel. The turbine chamber 24 serves as a second accommodation chamber for accommodating the turbine wheel 13 as the bladed wheel. The impeller chamber 25 accommodates a compressor impeller 14.

The one end of the rotary shaft 12 penetrates into the turbine chamber 24 through the first partition wall 11*a*. The turbine wheel 13 is fixed to the one end of the rotary shaft 12. The turbine wheel 13 is rotated together with the rotary shaft 12. The other end of the rotary shaft 12 penetrates into the impeller chamber 25 through the second partition wall 11*b*. The compressor impeller 14 is fixed to the other end of the rotary shaft 12. The compressor impeller 14 is rotated together with the rotary shaft 12.

The electric motor 16 is configured to rotate the rotary shaft 12. The electric motor 16 includes a motor rotor 15 fixed to the rotary shaft 12 and having a cylindrical shape and a motor stator 17 fixed to the housing 11 and having a cylindrical shape. The motor rotor 15 is disposed inside the motor stator 17 and rotated together with the rotary shaft 12. The motor rotor 15 includes a motor rotor core 15*a* and a plurality of permanent magnets (not illustrated). The motor rotor core 15*a* is fixed to the rotary shaft 12 and has a cylindrical shape. The permanent magnets are disposed in the motor rotor core 15*a*. The motor stator 17 surrounds the motor rotor 15. The motor stator 17 includes a motor stator core 17*a* and a coil 17*b*. The motor stator core 17*a* is fixed to the housing 11 and has a cylindrical shape. The coil 17*b* is wound around the motor stator core 17*a*. The coil 17*b* receives current from a battery (not illustrated) so that the motor rotor 15 is rotated together with the rotary shaft 12. This causes the turbine wheel 13 and the compressor impeller 14 to be rotated together with the rotary shaft 12. The rotary shaft 12 of the fluid machine 10 is rotated, for example, at a speed of 80,000 rpm or more.

The resolver 20 senses a rotation angle of the motor rotor 15. The resolver 20 includes a resolver rotor 21 fixed to the rotary shaft 12 and having a cylindrical shape and a resolver stator 22 fixed to the housing 11 and having a cylindrical shape. The resolver rotor 21 is disposed inside the resolver stator 22 and rotated together with the rotary shaft 12. The resolver stator 22 surrounds the resolver rotor 21. The resolver stator 22 includes a resolver stator core 22*a* and a coil 22*b*. The resolver stator core 22*a* is fixed to the housing 11 and has a cylindrical shape. The coil 22*b* is wound around the resolver stator core 22*a*. A resolver lead wire (not illustrated) extends from the coil 22*b* of the resolver stator 22. The resolver lead wire is electrically connected to a controller (not illustrated). The resolver 20 measures degrees of the rotation of the resolver rotor 21, and outputs the measured degrees of the rotation of the resolver rotor 21 as a resolver signal, which is a two-phase signal, from the coil 22*b* to the controller via the resolver lead wire.

The fluid machine 10 includes a first radial bearing 31 and a second radial bearing 32 that are disposed in the housing 11. The first radial bearing 31 and the second radial bearing 32 each have a cylindrical shape and support the rotary shaft 12 in a radial direction of the rotary shaft 12 such that the rotary shaft 12 is rotatable. The electric motor 16 is disposed between the first radial bearing 31 and the second radial bearing 32 along the axial direction of the rotary shaft 12. The first radial bearing 31 is located between the electric motor 16 and the turbine wheel 13. The second radial bearing 32 is located between the electric motor 16 and the compressor impeller 14.

The fluid machine 10 includes two thrust bearings 33 disposed in the housing 11. The thrust bearings 33 each have a flat ring shape and support the rotary shaft 12 in the axial direction of the rotary shaft 12 such that the rotary shaft 12 is rotatable. The thrust bearings 33 are disposed between the electric motor 16 and the compressor impeller 14, specifically, between the second radial bearing 32 and the compressor impeller 14 along the axial direction of the rotary shaft 12. The two thrust bearings 33 are supported by the housing 11.

As illustrated in FIG. 2, the first partition wall 11*a* has an insertion hole 11*h* through which the rotary shaft 12 is inserted. The first partition wall 11*a* serves as a partition wall that is disposed between the motor chamber 23 and the turbine chamber 24 and has the insertion hole 11*h*. The first partition wall 11*a* has a surface 11*d* adjacent to the motor chamber 23 and a surface 11*e* opposite to the surface 11*d* and adjacent to the turbine chamber 24. The insertion hole 11*h* is formed through the first partition wall 11*a* in a thickness direction of the first partition wall 11*a*, and opened on the surface 11*d* and the surface 11*e* of the first partition wall 11*a* respectively at one end and the other end of the insertion hole 11*h*.

The rotary shaft 12 has a first shaft portion 12*a*, a second shaft portion 12*b*, and a third shaft portion 12*c*. The first shaft portion 12*a*, the second shaft portion 12*b*, and the third shaft portion 12*c* each have a cylindrical shape. The first shaft portion 12*a*, the second shaft portion 12*b*, and the third shaft portion 12*c* are arranged in this order along the rotary shaft 12 from the one end toward the other end. The first shaft portion 12*a* has the largest outer diameter among outer diameters of the shaft portions 12*a*, 12*b*, 12*c*, and the second shaft portion 12*b* has the outer diameter larger than the outer diameter of the third shaft portion 12*c*. The outer diameters of the shaft portions 12*a*, 12*b*, 12*c* are smaller than an inner diameter of the insertion hole 11*h*. The first shaft portion 12*a*, the second shaft portion 12*b*, and the third shaft portion 12*c* are coaxial with each other. The first shaft portion 12*a*, the second shaft portion 12*b*, and the third shaft portion 12*c* cooperate to form the one end of the rotary shaft 12.

The rotary shaft 12 has a first receiving surface 121 that has an annular shape and connects an outer peripheral surface of the second shaft portion 12*b* to an outer peripheral surface of the third shaft portion 12*c*. The first receiving surface 121 has a flat-surface shape that extends in the radial direction of the rotary shaft 12. The rotary shaft 12 has a second receiving surface 122 that has an annular shape and connects an outer peripheral surface of the first shaft portion 12*a* to the outer peripheral surface of the second shaft portion 12*b*. The second receiving surface 122 has a flat-surface shape and extends in the radial direction of the rotary shaft 12. The second receiving surface 122, the second shaft portion 12*b*, the first receiving surface 121, and the third shaft portion 12*c* are located inside the motor chamber 23. The first shaft portion 12*a* protrudes into the turbine chamber 24 through the insertion hole 11*h*.

The second shaft portion 12*b* is passed through the resolver rotor 21. The resolver rotor 21 is disposed on the second shaft portion 12*b* and surrounds the outer peripheral surface of the second shaft portion 12*b*. The second shaft portion 12*b* has a length that is longer than the length of the resolver rotor 21 in the axial direction. The resolver rotor 21 is disposed on the second shaft portion 12*b* and is in contact with the first receiving surface 121. The resolver rotor 21 has an outer diameter that is smaller than the inner diameter of the insertion hole 11*h*.

The second shaft portion 12*b* has an external threads 120*b* on a part of the outer peripheral surface of the second shaft portion 12*b* that is more adjacent to the second receiving surface 122 than a part of the outer peripheral surface of the second shaft portion 12*b* on which the resolver rotor 21 is disposed. The external threads 120*b* is continued to the second receiving surface 122. A first nut 41 serving as a first fastener is mounted on the external threads 120*b* to fix the resolver rotor 21 to the rotary shaft 12. The first nut 41 has an outer diameter that is approximately equal to the outer diameter of the resolver rotor 21. Accordingly, the outer diameter of the first nut 41 is smaller than the inner diameter of the insertion hole 11*h*.

The first nut 41 has an internal threaded hole 41*a*. The internal threaded hole 41*a* is engaged with the external threads 120*b* of the second shaft portion 12*b* to press the resolver rotor 21 against the first receiving surface 121, so that the first nut 41 cooperates with the first receiving surface 121 to fix the resolver rotor 21 between the first nut 41 and the first receiving surface 121 in the axial direction of the rotary shaft 12. Accordingly, the resolver rotor 21 is held between the first nut 41 and the rotary shaft 12 and fixed to the second shaft portion 12*b*. The first nut 41 generates axial force to fix the resolver rotor 21 to the rotary shaft 12. The first receiving surface 121 receives the axial force from the first nut 41 in the motor chamber 23.

An end face of the first nut 41 distant from the resolver rotor 21 is located between the second receiving surface 122 and the first receiving surface 121 in the axial direction of the rotary shaft 12 with the resolver rotor 21 fixed to the rotary shaft 12 by the first nut 41. Accordingly, the second receiving surface 122 is located between the end face of the first nut 41 distant from the resolver rotor 21 and the turbine chamber 24 in the axial direction of the rotary shaft 12 with the resolver rotor 21 fixed to the rotary shaft 12 by the first nut 41.

The turbine wheel 13 includes a vane portion 13*a*. The vane portion 13*a* has a vane insertion hole 13*b* that extends in an axial direction of the turbine wheel 13 and through which the first shaft portion 12*a* is inserted. The vane portion 13*a* has a back surface 130*a* and a cylindrical portion 13*c* that has a cylindrical shape and protrudes from the back surface 130*a*. The cylindrical portion 13*c* is formed on the circumference of the vane insertion hole 13*b* and in communication with the vane insertion hole 13*b*.

The fluid machine 10 includes a seal ring 40 that is disposed inside the insertion hole 11*h* and creates a seal between the motor chamber 23 and the turbine chamber 24. A seal holding member 44 has a cylindrical shape, and is disposed inside the insertion hole 11*h*. The seal holding member 44 has an annular seal accommodation groove 43 in which the seal ring 40 is accommodated. The seal accommodation groove 43 and the seal ring 40 extend in a circumferential direction of the insertion hole 11*h*. Accordingly, in this embodiment, the seal holding member 44, which has the seal accommodation groove 43 in which the seal ring 40 is accommodated, is formed separately from the turbine wheel 13. The seal holding member 44 is, for example, made of iron.

The seal holding member 44 has a diameter L2 that is larger than an outer diameter L1 of the second shaft portion 12*b*, the outer diameter of the first nut 41, and the outer diameter of the resolver rotor 21. Accordingly, a part of the seal holding member 44 is disposed between the first nut 41 and the turbine wheel 13 in the axial direction of the rotary shaft 12. The seal accommodation groove 43 is formed in an outer peripheral surface of the seal holding member 44. The seal accommodation groove 43 has a bottom surface 43*a* that has a flat-surface shape extending in the axial direction of the rotary shaft 12. Accordingly, the bottom surface 43*a* of the seal accommodation groove 43 forms a cylindrical shape that surrounds the axis of the rotary shaft 12 and extends in the axial direction of the rotary shaft 12. The seal holding member 44 has the diameter L2 that is defined by the bottom surface 43*a* of the seal accommodation groove 43. The diameter L2 is larger than the outer diameter L1 of the second shaft portion 12*b*. The diameter L2 of the seal holding member 44, which is defined by the bottom surface 43*a* of the seal accommodation groove 43, is the minimum diameter of the seal accommodation groove 43 defined by the bottom surface 43*a* that forms an inner circumference of the seal accommodation groove 43. Further, in this embodiment, the outer diameter L1 of the second shaft portion 12*b* is an outer diameter of the most flexible portion of the rotary shaft 12. The seal ring 40 supported by the seal accommodation groove 43 creates a seal between an inner peripheral surface of the insertion hole 11*h* and the outer peripheral surface of the seal holding member 44.

The cylindrical portion 13*c* of the turbine wheel 13 is fitted into the seal holding member 44. The seal holding member 44 has a length that is equal to the length of the cylindrical portion 13*c* in the axial direction. The seal holding member 44 has an end face that is adjacent to the vane portion 13*a* and in contact with the back surface 130*a* of the vane portion 13*a* and the other end face that is distant from the vane portion 13*a* and located in plane with a distal end face of the cylindrical portion 13*c* with the cylindrical portion 13*c* fitted into the seal holding member 44.

The first shaft portion 12*a* has a protruding end portion 120 that is passed through the cylindrical portion 13*c* and the vane insertion hole 13*b* and protrudes from a distal end face 131*a* of the vane portion 13*a*. Accordingly, the rotary shaft 12 penetrates the resolver rotor 21, the insertion hole 11*h*, and the turbine wheel 13. The seal holding member 44 has an inner diameter that is smaller than the outer diameter of the second shaft portion 12*b*. Accordingly, an inner peripheral region of the other end face of the seal holding member 44 distant from the vane portion 13*a* and the distal end face of the cylindrical portion 13*c* face the second receiving surface 122 in the axial direction of the rotary shaft 12.

The protruding end portion 120 of the first shaft portion 12*a* has an external threads 120*a* on an outer peripheral surface of the protruding end portion 120. A second nut 42 serving as a second fastener is mounted on the external threads 120*a* to fix the turbine wheel 13 to the rotary shaft 12. The second nut 42 has an internal threaded hole 42*a*. The internal threaded hole 42*a* is engaged with the external threads 120*a* of the first shaft portion 12*a* to press the turbine wheel 13 and the seal holding member 44 against the second receiving surface 122, so that the second nut 42 cooperates with the second receiving surface 122 to fix the turbine wheel 13 and the seal holding member 44 between the second nut 42 and the second receiving surface 122 in the axial direction of the rotary shaft 12. The turbine wheel 13 is held between the second nut 42 and the rotary shaft 12 and fixed to the first shaft portion 12*a*. Accordingly, the rotary shaft 12 has the second shaft portion 12*b* that serves as a large-diameter portion to which the resolver rotor 21 is fixed and the first shaft portion 12*a* that serves as a small-diameter portion to which the turbine wheel 13 is fixed. The first shaft portion 12*a* has a diameter smaller than the diameter of the second shaft portion 12*b*.

The turbine wheel 13 and the seal holding member 44 are rotated together with the rotary shaft 12. The turbine wheel 13 and the seal holding member 44 cooperate to form a rotating body 45 that is fixed to the rotary shaft 12 and rotated together with the rotary shaft 12.

The second nut 42 generates axial force to fix the turbine wheel 13 and the seal holding member 44 to the rotary shaft 12. Accordingly, the resolver rotor 21 is fixed by the first nut 41 in the same direction as the turbine wheel 13 is fixed by the second nut 42 along the axial direction of the rotary shaft 12. The first nut 41 is fixed to the second shaft portion 12*b*, and the second nut 42 is fixed to the first shaft portion 12*a*. The resolver rotor 21 is fixed by the first nut 41 at a position away from a position where the turbine wheel 13 is fixed by the second nut 42 in the radial direction of the rotary shaft 12.

The second receiving surface 122 is located between the end face of the first nut 41 distant from the resolver rotor 21 and the turbine chamber 24 in the axial direction of the rotary shaft 12 with the resolver rotor 21 fixed to the rotary shaft 12 by the first nut 41. The seal holding member 44 is distant from the first nut 41 in the axial direction of the rotary shaft 12. Accordingly, a clearance is formed between the seal holding member 44 and the first nut 41 in the axial direction of the rotary shaft 12.

The following will describe a method for fixing the resolver rotor 21 and the turbine wheel 13 to the rotary shaft 12.

First, the first shaft portion 12*a* of the rotary shaft 12 is inserted from the motor chamber 23 into the turbine chamber 24 through the insertion hole 11*h* so that the first shaft portion 12*a* protrudes into the turbine chamber 24. The first shaft portion 12*a* is inserted through the resolver rotor 21. Then, the resolver rotor 21 is passed from the turbine chamber 24 to the motor chamber 23 through the insertion hole 11*h* to be placed in the motor chamber 23 with the second shaft portion 12*b* inside the resolver rotor 21. The resolver rotor 21 is disposed on the rotary shaft 12 such that the resolver rotor 21 surrounds the outer peripheral surface of the second shaft portion 12*b* and is in contact with the first receiving surface 121.

Next, the first shaft portion 12*a* is passed through the first nut 41. The first nut 41 is then passed through the insertion hole 11*h* from the turbine chamber 24 so that the internal threaded hole 41*a* of the first nut 41 is engaged with the external threads 120*b* of the second shaft portion 12*b*. The first nut 41 is tightened to the external threads 120*b* of the second shaft portion 12*b* so that the first nut 41 comes into contact with the resolver rotor 21 and cooperates with the first receiving surface 121 to hold the resolver rotor 21 between the first nut 41 and the first receiving surface 121. The axial force of the first nut 41 is transmitted to the first receiving surface 121 via the resolver rotor 21. That is, the first receiving surface 121 receives the axial force of the first nut 41, so that the resolver rotor 21 is fixed to the first shaft portion 12*a*.

Then, the cylindrical portion 13*c* of the turbine wheel 13 is fitted into the seal holding member 44 with the seal ring 40 preliminarily disposed in the seal accommodation groove 43 so that the first shaft portion 12*a* is inserted through the cylindrical portion 13*c* and the vane insertion hole 13*b* of the rotating body 45, which is integrally formed by the seal holding member 44 and the turbine wheel 13. While the seal holding member 44 and the cylindrical portion 13*c* are placed inside the insertion hole 11*h*, the seal holding member 44 and the turbine wheel 13 are disposed on the first shaft portion 12*a* such that the inner peripheral region of the other end face of the seal holding member 44 distant from the vane portion 13*a* and the distal end face of the cylindrical portion 13*c* are in contact with the second receiving surface 122. The seal ring 40 supported by the seal accommodation groove 43 is disposed inside the insertion hole 11*h* and creates a seal between the inner peripheral surface of the insertion hole 11*h* and the outer peripheral surface of the seal holding member 44.

Then, the internal threaded hole 42*a* of the second nut 42 is engaged with the external threads 120*a* of the protruding end portion 120 of the first shaft portion 12*a*. The second nut 42 is tightened to the external threads 120*a* of the protruding end portion 120 so that the second nut 42 comes into contact with the distal end face 131*a* of the vane portion 13*a* and cooperates with the second receiving surface 122 to hold the turbine wheel 13 and the seal holding member 44 between the second nut 42 and the second receiving surface 122. The axial force of the second nut 42 is transmitted to the second receiving surface 122 via the turbine wheel 13 and the seal holding member 44. That is, the second receiving surface 122 receives the axial force of the second nut 42, so that the rotating body 45, which is formed by the turbine wheel 13 and the seal holding member 44, is fixed to the rotary shaft 12. Accordingly, the resolver rotor 21 and the turbine wheel 13 are fixed to the rotary shaft 12.

Next, the following will describe the operation of the fluid machine 10 according to the first embodiment.

While the resolver rotor 21 is fixed by the first nut 41 in the same direction as the turbine wheel 13 is fixed by the second nut 42 along the axial direction of the rotary shaft 12, the resolver rotor 21 is fixed by the first nut 41 at a position away in the radial direction of the rotary shaft 12 from a position where the turbine wheel 13 is fixed by the second nut 42. This configuration prevents the resolver rotor 21 from receiving the axial force from the second nut 42. Accordingly, even if creep occurs in the resolver rotor 21, for example, the axial force of the second nut 42 does not decrease. Further, the diameter L2 of the seal holding member 44 defined by the bottom surface 43*a* of the seal accommodation groove 43 is larger than the outer diameter L1 of the second shaft portion 12*b*. That is, the minimum diameter of the seal accommodation groove 43 defined by the inner circumference of the seal accommodation groove 43 is larger than the outer diameter of the most flexible portion of the rotary shaft 12. This configuration allows the eigenvalue of the rotary shaft 12 to be easily secured, thereby reducing the runout of the rotary shaft 12.

The first embodiment provides the following advantageous effects.

(1-1) While the resolver rotor 21 is fixed by the first nut 41 in the same direction as the turbine wheel 13 is fixed by the second nut 42 along the axial direction of the rotary shaft 12, the resolver rotor 21 is fixed by the first nut 41 at a position away in the radial direction of the rotary shaft 12 from a position where the turbine wheel 13 is fixed by the second nut 42. This configuration prevents the resolver rotor 21 from receiving the axial force from the second nut 42. Accordingly, even if creep occurs in the resolver rotor 21, for example, the axial force of the second nut 42 does not decrease. This allows the resolver rotor 21 and the turbine wheel 13 to be stably fixed to the rotary shaft 12 respectively by the first nut 41 and the second nut 42. This therefore facilitates the high-speed rotation of the rotary shaft 12 by the electric motor 16.

(1-2) The cylindrical seal holding member 44 having the seal accommodation groove 43 is disposed inside the insertion hole 11*h*, and the clearance is formed between the seal holding member 44 and the first nut 41 in the axial direction of the rotary shaft 12. This configuration allows, for example, the seal holding member 44 to be made of material different from the material of the turbine wheel 13. For example, the seal holding member 44 may be made of material with higher strength than that of the turbine wheel 13. This enhances the durability of the fluid machine 10.

(1-3) The minimum diameter of the seal accommodation groove 43 defined by the inner circumference of the seal accommodation groove 43 is larger than the outer diameter of the most flexible portion of the rotary shaft 12. This configuration allows the eigenvalue of the rotary shaft 12 to be easily secured, thereby reducing the runout of the rotary shaft 12. Therefore, this facilitates the high-speed rotation of the rotary shaft 12 by the electric motor 16.

(1-4) The cylindrical seal holding member 44 is disposed inside the insertion hole 11*h*. The seal holding member 44 is rotated together with the rotary shaft 12, and has the annular seal accommodation groove 43 in which the seal ring 40 is accommodated. This configuration eliminates the need to form the seal accommodation groove 43, which supports the seal ring 40, in the outer peripheral surface of the rotary shaft 12, thereby preventing the reduction in the outer diameter of the rotary shaft 12 due to the formation of the seal accommodation groove 43. This therefore reduces the runout of the rotary shaft 12.

Second Embodiment

Figure 3:
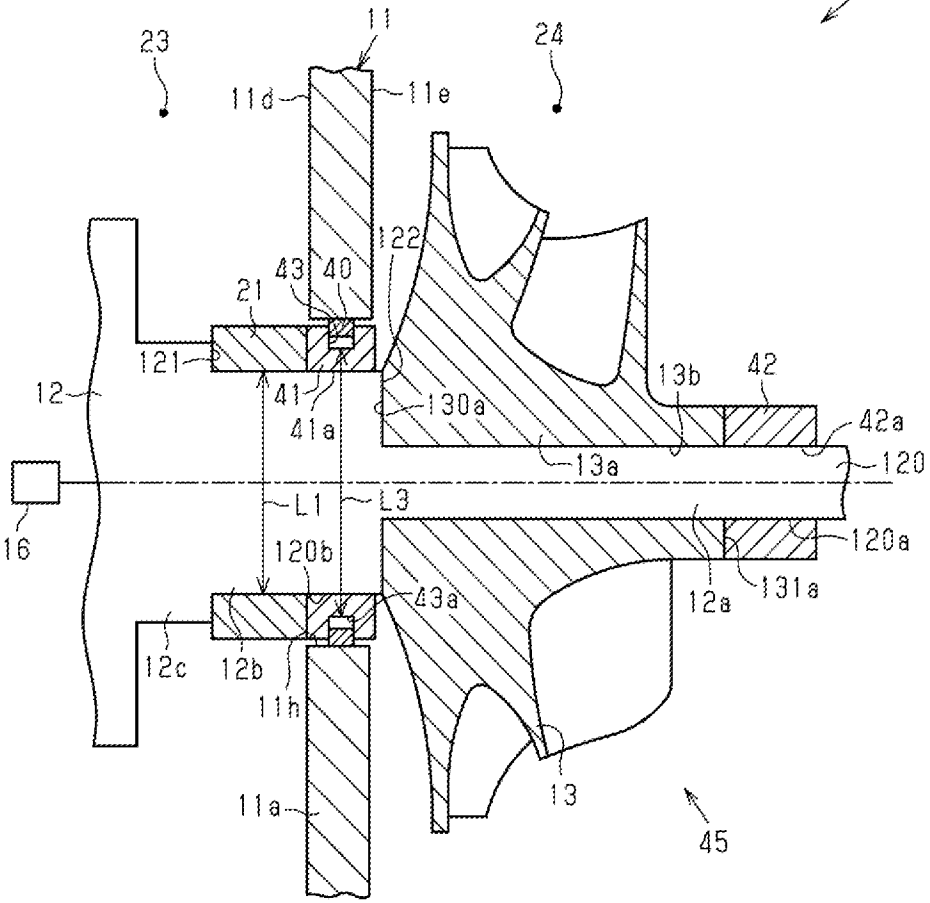
FIG. 3 is an enlarged sectional view of a fluid machine according to a second embodiment of the present disclosure.

The following will describe a second embodiment of a fluid machine with reference to accompanying FIG. 3. Note that in the following embodiment of the present disclosure, components having substantially the same configuration as that of the first embodiment will be denoted by the same reference numerals, and redundant description will be omitted. The second embodiment does not include the seal holding member 44 that is mentioned in the first embodiment, and the second embodiment is different from the first embodiment in that a first nut serves as a seal holding member that has a seal accommodation groove in which a seal ring is accommodated.

As illustrated in FIG. 3, a part of the external threads 120*b* of the second shaft portion 12*b* protrudes into the turbine chamber 24 through the insertion hole 11*h*. Accordingly, the second receiving surface 122 is located in the turbine chamber 24. The most part of the external threads 120*b* of the second shaft portion 12*b* is located inside the insertion hole 11*h*.

The first nut 41 is mounted on the external threads 120*b* of the second shaft portion 12*b*, so that the first nut 41 is disposed inside the insertion hole 11*h*. The first nut 41 has the annular seal accommodation groove 43 in which the seal ring 40 is accommodated. The seal accommodation groove 43 is formed in an outer peripheral surface of the first nut 41 and extends in the circumferential direction of the insertion hole 11*h*. The seal ring 40 is disposed inside the insertion hole 11*h* and extends in the circumferential direction of the insertion hole 11*h*. In the second embodiment, the first nut 41 serves as the first fastener that fixes the resolver rotor 21 to the rotary shaft 12, and also serves as the seal holding member that has a cylindrical shape and has the seal accommodation groove 43 in which the seal ring 40 is accommodated. The first nut 41 has a diameter L3 that is defined by the bottom surface 43*a* of the seal accommodation groove 43. The diameter L3 is larger than the outer diameter L1 of the second shaft portion 12*b*. The diameter L3 of the first nut 41, which is defined by the bottom surface 43*a* of the seal accommodation groove 43, is the minimum diameter of the seal accommodation groove 43 defined by the bottom surface 43*a* that forms the inner circumference of the seal accommodation groove 43. Further, the outer diameter L1 of the second shaft portion 12*b* is the outer diameter of the most flexible portion of the rotary shaft 12. The diameter L3 of the first nut 41, which is the minimum diameter of the seal accommodation groove 43 defined by the inner circumference of the seal accommodation groove 43, is larger than the outer diameter L1 of the second shaft portion 12*b*.

The back surface 130*a* of the vane portion 13*a* is in contact with the second receiving surface 122 of the rotary shaft 12 in the turbine chamber 24. The second nut 42 cooperates with the second receiving surface 122 to hold the turbine wheel 13 between the second nut 42 and the second receiving surface 122 in the axial direction of the rotary shaft 12 to fix the turbine wheel 13 to the rotary shaft 12. In this embodiment, the turbine wheel 13 serves as the rotating body to which the rotary shaft 12 is fixed. The vane portion 13*a* is distant from the first nut 41 in the axial direction of the rotary shaft 12. That is, the turbine wheel 13 is distant from the first nut 41 in the axial direction of the rotary shaft 12. Accordingly, a clearance is formed between the first nut 41 and the turbine wheel 13 in the axial direction of the rotary shaft 12.

The following will describe a method for fixing the resolver rotor 21 and the turbine wheel 13 to the rotary shaft 12.

First, the first shaft portion 12*a* and the second shaft portion 12*b* of the rotary shaft 12 are inserted from the motor chamber 23 into the turbine chamber 24 through the insertion hole 11*h*, so that the first shaft portion 12*a* and a part of the external threads 120*b* of the second shaft portion 12*b* protrude into the turbine chamber 24. The first shaft portion 12*a* is inserted through the resolver rotor 21. Then, the resolver rotor 21 is passed from the turbine chamber 24 to the motor chamber 23 through the insertion hole 11*h* to be placed in the motor chamber 23 with the second shaft portion 12*b* inside the resolver rotor 21. The resolver rotor 21 is disposed on the rotary shaft 12 such that the resolver rotor 21 surrounds the outer peripheral surface of the second shaft portion 12*b* and is in contact with the first receiving surface 121.

Next, the first shaft portion 12*a* is passed through the first nut 41 in which the seal ring 40 is preliminarily accommodated in the seal accommodation groove 43. Then, the first nut 41 is then inserted into the insertion hole 11*h* so that the internal threaded hole 41*a* of the first nut 41 is engaged with the external threads 120*b* of the second shaft portion 12*b*. The first nut 41 is tightened to the external threads 120*b* of the second shaft portion 12*b* so that the first nut 41 comes into contact with the resolver rotor 21 and cooperates with the first receiving surface 121 to hold the resolver rotor 21 between the first nut 41 and the first receiving surface 121. The axial force of the first nut 41 is transmitted to the first receiving surface 121 via the resolver rotor 21. That is, the first receiving surface 121 receives the axial force of the first nut 41, so that the resolver rotor 21 is fixed to the rotary shaft 12. The seal ring 40 supported by the seal accommodation groove 43 is disposed inside the insertion hole 11*h* and creates a seal between the inner peripheral surface of the insertion hole 11*h* and the outer peripheral surface of the seal holding member 44.

Then, the first shaft portion 12*a* is inserted through the vane insertion hole 13*b* of the vane portion 13*a*. The turbine wheel 13 is disposed on the first shaft portion 12*a* such that the back surface 130*a* of the vane portion 13*a* is in contact with the second receiving surface 122. Then, the internal threaded hole 42*a* of the second nut 42 is engaged with the external threads 120*a* of the protruding end portion 120 of the first shaft portion 12*a*. The second nut 42 is tightened to the external threads 120*a* of the protruding end portion 120 so that the second nut 42 comes into contact with the distal end face 131*a* of the vane portion 13*a* and cooperates with the second receiving surface 122 to hold the turbine wheel 13 between the second nut 42 and the second receiving surface 122. The axial force of the second nut 42 is transmitted to the second receiving surface 122 via the turbine wheel 13. That is, the second receiving surface 122 receives the axial force of the second nut 42, so that the turbine wheel 13 is fixed to the rotary shaft 12. Accordingly, the resolver rotor 21 and the turbine wheel 13 are fixed to the rotary shaft 12.

Next, the following will describe the operation of the fluid machine 10 according to the second embodiment.

While the resolver rotor 21 is fixed by the first nut 41 in the same direction as the turbine wheel 13 is fixed by the second nut 42 along the axial direction of the rotary shaft 12, the resolver rotor 21 is fixed by the first nut 41 at a position away in the radial direction of the rotary shaft 12 from a position where the turbine wheel 13 is fixed by the second nut 42. This configuration prevents the resolver rotor 21 from receiving the axial force from the second nut 42. Accordingly, even if creep occurs in the resolver rotor 21, for example, the axial force of the second nut 42 does not decrease. The diameter L3 of the first nut 41, which is defined by the bottom surface 43*a* of the seal accommodation groove 43, is larger than the outer diameter L1 of the second shaft portion 12*b*. That is, the minimum diameter of the seal accommodation groove 43 defined by the inner circumference of the seal accommodation groove 43 is larger than the outer diameter of the most flexible portion of the rotary shaft 12. This configuration allows the eigenvalue of the rotary shaft 12 to be easily secured, thereby reducing the runout of the rotary shaft 12.

The second embodiment provides the following advantageous effects in addition to the effects mentioned in (1-1), (1-3), and (1-4) of the first embodiment.

(2-1) The first nut 41 having the seal accommodation groove 43 is disposed inside the insertion hole 11*h*, and the clearance is formed between the first nut 41 and the turbine wheel 13 in the axial direction of the rotary shaft 12. This configuration enables the first nut 41 for fixing the resolver rotor 21 to the rotary shaft 12 to also serve as the seal holding member, thereby allowing the size reduction of the fluid machine 10 in the axial direction of the rotary shaft 12, compared with a fluid machine provided with a seal holding member in addition to the first nut 41.

The aforementioned embodiments may be modified as below. The embodiments may be combined with the following modifications within technically consistent range.

In the first embodiment, the seal holding member 44 is formed of a different member from that of the turbine wheel 13. However, it is not limited to this configuration, and the turbine wheel 13 may have the seal accommodation groove 43 and a part of the turbine wheel 13 may serve as the seal holding member 44. For example, the outer peripheral surface of the cylindrical portion 13*c* may have the seal accommodation groove 43 so that the seal ring 40 supported by the seal accommodation groove 43 creates a seal between the inner peripheral surface of the insertion hole 11*h* and the outer peripheral surface of the cylindrical portion 13*c*. In this configuration, the cylindrical portion 13*c* serves as the cylindrical seal holding member that is disposed inside the insertion hole 11*h*, extends in the circumferential direction of the insertion hole 11*h*, and has the annular seal accommodation groove 43 in which the seal ring 40 is accommodated. The seal holding member may be formed integrally with the turbine wheel 13.

In the first embodiment, the seal holding member 44 is made of iron, but the material of the seal holding member 44 is not limited to iron. That is, the material of the seal holding member 44 may be any material with strength that is enough to support the seal ring 40 when the seal holding member 44 is rotated together with the rotary shaft 12.

In the first embodiment, the second receiving surface 122 may be located inside the insertion hole 11*h*. That is, the seal ring 40 only has to create a seal between the motor chamber 23 and the turbine chamber 24 inside the insertion hole 11*h*. However, it is limited to a configuration in which the turbine wheel 13 does not interfere with the first partition wall 11*a*.

In the aforementioned embodiments, a collar may be adopted as the first fastener that fixes the resolver rotor 21 to the rotary shaft 12, and also as the second fastener that fixes the turbine wheel 13 to the rotary shaft 12. For example, the collar serving as the first fastener may be press-fitted into the rotary shaft 12 to generate axial force for fixing the resolver rotor 21 to the rotary shaft 12. Further, for example, the collar serving as the second fastener may be press-fitted into the rotary shaft 12 to generate axial force for fixing the turbine wheel 13 to the rotary shaft 12.

In the aforementioned embodiments, the resolver rotor 21 is disposed in the motor chamber 23 at a position adjacent to the turbine chamber 24. However, the resolver rotor 21 may be disposed in the motor chamber 23 at a position adjacent to the impeller chamber 25. In this configuration, the compressor impeller 14 serves as the bladed wheel and the impeller chamber 25 serves as the second accommodation chamber. That is, the resolver rotor 21 only has to be disposed in the motor chamber 23 and sense a rotation angle of the motor rotor 15.

In the aforementioned embodiments, the first receiving surface 121 and the second receiving surface 122 are respectively in contact with the resolver rotor 21 and the rotating body 45. However, some element may be disposed between the first receiving surface 121 and the resolver rotor 21 and also between the second receiving surface 122 and the rotating body 45. That is, the first receiving surface 121 and the second receiving surface 122 only have to receive the axial force of the first nut 41 and the axial force of the second nut 42, respectively.

In the aforementioned embodiments, the fluid machine 10 includes both of the turbine wheel 13 and the compressor impeller 14. However, for example, the fluid machine 10 may not include the turbine wheel 13 or the compressor impeller 14. For example, if the fluid machine 10 does not include the turbine wheel 13, the compressor impeller 14 serves as the bladed wheel and the impeller chamber 25 serves as the second accommodation chamber.

In the aforementioned embodiments, the first receiving surface 121 and the second receiving surface 122 are each a flat surface that extends in the radial direction of the rotary shaft 12. However, the first receiving surface 121 and the second receiving surface 122 may be each a taper surface that extends in a direction oblique to the axial direction of the rotary shaft 12. That is, the first receiving surface 121 and the second receiving surface 122 only have to receive the axial force of the first nut 41 and the axial force of the second nut 42, respectively, and the shapes of the first receiving surface 121 and the second receiving surface 122 are not limited to the shape mentioned in the embodiments.

What is claimed is:

1. A fluid machine comprising:

a bladed wheel rotated together with a rotary shaft;

an electric motor including a motor rotor fixed to the rotary shaft, the electric motor being configured to rotate the rotary shaft;

a resolver including a resolver rotor that has a cylindrical shape, the resolver being configured to sense a rotation angle of the motor rotor;

a first fastener for fixing the resolver rotor to the rotary shaft; and a second fastener for fixing the bladed wheel to the rotary shaft, wherein the rotary shaft has a large-diameter portion and a small-diameter portion that has a diameter smaller than a diameter of the large-diameter portion, the resolver rotor is held between the first fastener and the rotary shaft and fixed to the large-diameter portion, the bladed wheel is held between the second fastener and the rotary shaft and fixed to the small-diameter portion, and while the resolver rotor is fixed by the first fastener in a same direction as the bladed wheel is fixed by the second fastener along an axial direction of the rotary shaft, and the resolver rotor is fixed by the first fastener at a position away in a radial direction of the rotary shaft from a position where the bladed wheel is fixed by the second fastener so that the resolver rotor does not receive an axial force from the second fastener.

2. The fluid machine according to claim 1, wherein the fluid machine comprises:

a housing having a first accommodation chamber for accommodating the electric motor and the resolver and a second accommodation chamber for accommodating the bladed wheel, the housing including a partition wall that is disposed between the first accommodation chamber and the second accommodation chamber and has an insertion hole through which the rotary shaft is inserted;

a seal ring that is disposed inside the insertion hole, extends in a circumferential direction of the insertion hole, and creates a seal between the first accommodation chamber and the second accommodation chamber; and a seal accommodation groove in which the seal ring is accommodated, the seal accommodation groove having an annular shape, being located in the insertion hole, and extending in the circumferential direction of the insertion hole, the seal accommodation groove is formed in a seal holding member that has a cylindrical shape and is disposed inside the insertion hole, and a clearance is formed between the seal holding member and the first fastener in the axial direction of the rotary shaft.

3. The fluid machine according to claim 1, wherein the fluid machine comprises:

a housing having a first accommodation chamber for accommodating the electric motor and the resolver and a second accommodation chamber for accommodating the bladed wheel, the housing including a partition wall that is disposed between the first accommodation chamber and the second accommodation chamber and has an insertion hole through which the rotary shaft is inserted;

a seal ring that is disposed inside the insertion hole, extends in a circumferential direction of the insertion hole, and creates a seal between the first accommodation chamber and the second accommodation chamber; and a seal accommodation groove in which the seal ring is accommodated, the seal accommodation groove having an annular shape, being located in the insertion hole, and extending in the circumferential direction of the insertion hole, the seal accommodation groove is formed in the first fastener that is disposed inside the insertion hole, and a clearance is formed between the first fastener and the bladed wheel in the axial direction of the rotary shaft.

4. The fluid machine according to claim 2, wherein a minimum diameter of the seal accommodation groove defined by an inner circumference of the seal accommodation groove is larger than an outer diameter of a most flexible portion of the rotary shaft.

* * * * *